US007931453B2

(12) United States Patent
Masao

(10) Patent No.: US 7,931,453 B2
(45) Date of Patent: Apr. 26, 2011

(54) CAPACITY VARIABLE DEVICE FOR ROTARY COMPRESSOR AND DRIVING METHOD OF AIR CONDITIONER HAVING THE SAME

(75) Inventor: Ozu Masao, Fuji (JP)

(73) Assignee: LG Electronics Inc., Seoul (KR)

( * ) Notice: Subject to any disclaimer, the term of this patent is extended or adjusted under 35 U.S.C. 154(b) by 1071 days.

(21) Appl. No.: 11/659,323

(22) PCT Filed: Aug. 4, 2005

(86) PCT No.: PCT/KR2005/002538

§ 371 (c)(1),
(2), (4) Date: Feb. 5, 2007

(87) PCT Pub. No.: WO2006/014081

PCT Pub. Date: Feb. 9, 2006

(65) Prior Publication Data

US 2008/0307808 A1 Dec. 18, 2008

(51) Int. Cl.
*F04B 23/00* (2006.01)
*F04B 49/00* (2006.01)

(52) U.S. Cl. ..... 417/440; 417/307; 417/310

(58) Field of Classification Search ..... 417/283, 417/310, 440, 213, 307; 62/196.4, 196.1; 418/54, 63; 137/512.2, 512.3, 512.5, 513.3, 137/513.5

See application file for complete search history.

(56) References Cited

U.S. PATENT DOCUMENTS

| | | | | | |
|---|---|---|---|---|---|
| 3,767,328 | A | * | 10/1973 | Ladusaw | 417/310 |
| 4,522,038 | A | * | 6/1985 | Ozu | 62/228.5 |
| 4,558,993 | A | * | 12/1985 | Hori et al. | 417/283 |
| 4,726,739 | A | * | 2/1988 | Saitou et al. | 417/286 |
| 4,780,067 | A | * | 10/1988 | Suzuki et al. | 417/441 |
| 4,805,666 | A | * | 2/1989 | Araki et al. | 137/625.43 |
| 4,892,466 | A | * | 1/1990 | Taguchi et al. | 417/295 |
| 5,074,761 | A | * | 12/1991 | Hirooka et al. | 417/310 |
| 5,152,156 | A | * | 10/1992 | Tokairin | 62/498 |
| 5,775,882 | A | * | 7/1998 | Kiyokawa et al. | 417/310 |
| 2002/0187057 | A1 | | 12/2002 | Loprete et al. | |

FOREIGN PATENT DOCUMENTS

| | | |
|---|---|---|
| JP | 58010184 | 1/1983 |
| JP | 1155163 | 6/1989 |
| JP | 02-22691 | 2/1990 |
| JP | 02-049994 | 2/1990 |

OTHER PUBLICATIONS

Japanese Office Action dated Sep. 11, 2009.

* cited by examiner

*Primary Examiner* — Charles G Freay
*Assistant Examiner* — Alexander B Comley
(74) *Attorney, Agent, or Firm* — KED & Associates LLP

(57) ABSTRACT

A capacity variable device for a rotary compressor and an operation method of an air conditioner having the same are provided. The capacity variable device includes a valve hole in which a sliding valve slidingly inserted is formed at a cylinder, and a bypass hole formed to cross the valve hole and communicating with an intake hole of the cylinder such that resistance of a refrigerant being bypassed is reduced and the operation is performed with its cooling capability lowered. Various operation modes of the air conditioner employing the same are performed and a power consumption is reduced, thus, the efficiency of the compressor is improved. In addition, a structure of the capacity variable device is simplified, thereby lowering a manufacturing cost, simplifying assembly and thusly improving productivity.

26 Claims, 9 Drawing Sheets

CAPACITY VARIABLE DEVICE FOR ROTARY COMPRESSOR AND DRIVING METHOD OF AIR CONDITIONER HAVING THE SAME

TECHNICAL FIELD

The present invention relates to a capacity variable device for a rotary compressor, and particularly, to a capacity variable device for a rotary compressor and its operation method capable of controlling cooling capability by discharging a refrigerant gas of a compression chamber as occasion demands.

BACKGROUND ART

In general, a rotary compressor is used for an air conditioner. As functions of the air conditioner are diversified, a rotary compressor that can vary its capacity is being required.

As techniques for varying the capacity of the rotary compressor, what so called an inverter method of controlling the revolutions of the compressor by employing an inverter motor has been well known. However, this technique is problematic for the following reasons. First, the inverter motor itself is expensive, which causes an increase in unit cost. Also, even though most air conditioners are used as cooling devices, improving cooling capability under the cool circumstance is more difficult than improving the capability under the warm circumstance.

For this reason, instead of the inverter method, "a technique of varying the capability of compressing a refrigerant by capacity exclusion switching" (an idling or compressing conversion technique) is being widely used, in which a portion of a refrigerant gas being compressed in a cylinder is directed outside the cylinder to vary the capacity of the compression chamber.

However, because refrigerant bypasses through the valve, most capacity variable compressors employing the idling or compression conversion technique have the disadvantage of the high resistance of bypass circuit. Therefore, a cooling capability lowering rate in capacity exclusion operation is only 80~85% of the cooling capability lowering rate in capacity filled operation.

Also, because those compressors cannot speedily switch their operation modes, there is a limit in using them for compressors or air conditioners that require frequent cooling-capability control.

DISCLOSURE OF THE INVENTION

Therefore, it is an object of the present invention to provide a capacity variable device for a rotary compressor and an operation method of an air conditioner having the same capable of variously controlling an air conditioner and preventing unnecessary power consumption by increasing a cooling-capability lowering rate in capacity exclusion operation.

It is another object of the present invention to provide a capacity variable device for a rotary compressor and an operation method of an air conditioner having the same, whereby the capacity variable device can speedily convert its operation mode such that it can be used for a compressor or an air conditioner which should perform frequent cooling-capability control.

To achieve the above object, there is provided a capacity variable device for a rotary compressor comprising: a casing that is provided with a gas intake pipe communicating with an evaporator and a gas discharge pipe communicating with a condenser; a cylinder that is fixedly installed inside the casing and has an intake hole penetratingly formed in a radial direction and directly communicating with a gas intake pipe, a valve hole penetratingly formed in a radial direction at a predetermined angle with respect to the intake hole, a bypass hole penetrating the middle portion of the valve hole in an axial direction and excluding a portion of a refrigerant, and a communication hole guiding to an intake chamber, the refrigerant excluded to the bypass hole; a plurality of bearing plates that form an internal space by covering both upper and lower sides of the cylinder together, a discharge hole communicating with an internal space of the cylinder, and discharging a compression refrigerant, and a gas flow path at at least one side, the gas flow path connecting the bypass hole with the communication hole; a rolling piston that is coupled to a rotary shaft of a driving motor rotating at a constant speed and compresses a refrigerant gas by a centrifugal force while orbiting within the cylinder; a vane that is coupled to the vane slit of the cylinder movably in a radial direction to pressingly contact with an outer circumferential surface of the rolling piston and divides the internal space of the cylinder into an intake chamber and a compression chamber; a sliding valve that is installed in the valve hole of the cylinder to slide in a radial direction and opens and closes the bypass hole of the cylinder; and a back pressure switching unit that is differentially supplies back pressure to a rear surface of the sliding valve, such that the sliding valve slides within the valve hole according to an operation mode of the compressor to open and close the bypass hole.

To achieve the above object, there is provided a capacity variable device for a rotary compressor, comprising: a casing that is provided with a gas intake pipe communicating with an evaporator and a gas discharge pipe communicating with a condenser; a cylinder that is fixedly installed inside the casing and has an intake hole penetratingly formed in a radial direction and directly communicating with a gas intake pipe, a vane slit formed at one side of the intake hole in a radial direction, a valve hole penetratingly formed in a radial direction at a predetermined angle with respect to the intake hole, and a bypass hole penetrating the middle portion of the valve hole in a radial direction and excluding a portion of a refrigerant; a plurality of bearing plates that form an internal space by covering both upper and lower sides of the cylinder together, a discharge hole communicating with an internal space of the cylinder and discharging a compression refrigerant, and a gas storage groove at at least one side, the gas storage groove communicating with the bypass hole of the cylinder so that it temporarily stores a refrigerant and returns the refrigerant to the cylinder through the bypass hole; a rolling piston that is coupled to a rotary shaft of a driving motor rotating at a constant speed and compresses a refrigerant gas by a centrifugal force while orbiting within the cylinder, a vane that is coupled to the vane slit of the cylinder movably in a radial direction to pressingly contact with an outer circumferential surface of the rolling piston and divides the internal space of the cylinder into an intake chamber and a compression chamber; a sliding valve that is installed at the valve hole of the cylinder to slide in a radial direction and opens and closes the bypass hole of the cylinder; and a back pressure switching unit that differentially supplies back pressure to a rear surface of the sliding valve, such that the sliding valve slides within the valve hole according to an operation mode of the compressor to open and close the bypass hole.

To achieve the above object, there is provided a capacity variable device for a rotary compressor, comprising: a casing that is provided with a gas intake pipe communicating with an evaporator and a gas discharge pipe communicating with a condenser, a cylinder that is fixedly installed inside the casing and has an intake hole penetratingly formed in a radial direction and directly communicating with a gas intake pipe, a vane slit formed at one side of the intake hole in a radial direction, a valve hole penetratingly formed in a radial direction at a predetermined angle with respect to the intake hole, and a bypass hole penetrating the middle portion of the valve hole in a radial direction and excluding a portion of refrigerant; a plurality of bearing plates that form an internal space by covering both upper and lower sides of the cylinder together, a discharge hole communicating with an internal space of the cylinder and discharging a compression refrigerant, and a guiding hole at at least one side, the guiding hole communicating with the bypass hole of the cylinder and penetrating the outer circumferential surface; a gas storage container that is connected to the guiding hole of the bearing plate and is installed outside the casing so as to temporarily store a refrigerant excluded from the cylinder and return the refrigerant to the cylinder through the bypass hole; a rolling piston that is coupled to a rotary shaft of a driving motor rotating at a constant speed and compresses a refrigerant gas by a centrifugal force while orbiting within the cylinder; a vane that is coupled to the vane slit of the cylinder movably in a radial direction to pressingly contact with an outer circumferential surface of the rolling piston and divides the internal space of the cylinder into an intake chamber and a compression chamber; a sliding valve that is installed at the valve hole of the cylinder to slide in a radial direction and opens and closes the bypass hole of the cylinder; and a back pressure switching unit that differentially supplies back pressure to a rear surface of the sliding valve, such that the sliding valve slides within the valve hole according to an operation mode of the compressor to open and close the bypass hole.

To achieve the above object, there is provided an operation method of an air conditioner provided with a capacity variable rotary compressor of claims 1 and 2, the method comprising: a starting operation mode in which, when a rotary compressor including a bypass hole and a sliding valve opening and closing the bypass hole at a cylinder is started, the operation is performed while a portion of a compression gas within the cylinder is excluded through the bypass hole for a certain period of time; a power. operation mode in which the operation is performed in a state that the sliding valve blocks the bypass hole of the cylinder when a temperature of an indoor unit is higher than a set temperature (A) during the starting operation mode upon comparison of the indoor unit temperature with the set temperature (A); a saving operation mode in which the operation is performed while a portion of a compression gas is excluded by opening the bypass hole of the cylinder when the temperature of the indoor unit is lower than the set temperature (A) during in the power operation mode upon comparison of the indoor unit temperature with the set temperature (A); and a stopping mode in which the operation is stopped by turning off power when the temperature of the indoor unit is lower than a set temperature (B) during in the saving operation mode upon comparison of the indoor unit temperature with the set temperature (B).

EFFECT

In a capacity variable device for a rotary compressor and an operation method of an air conditioner having the same in accordance with the present invention, a valve hole in which a sliding valve slidingly inserted is formed at a cylinder, a bypass hole is formed to cross the valve hole and communicate with an intake hole of the cylinder, such that resistance of a refrigerant being bypassed is reduced and the operation can be thusly performed with its cooling capability lowered. Accordingly, the efficiency of the compressor can be greatly improved. Also, various operation modes of an air conditioner employing the same can be performed and unnecessary power consumption can be reduced thanks to capacity variable operation. In addition, a structure of the capacity variable device is simplified, thereby lowering a manufacturing cost, simplifying assembly and thusly improving productivity.

Also, by using a pilot valve which is economical and reliable, back pressure of the sliding valve can be speedily and accurately switched. Accordingly, the capacity variable device in accordance with the present invention can be widely used for a compressor or an air conditioner that should perform frequent cooling capability control, and efficiency degradation thereof can be prevented from occurring.

MODES FOR CARRYING OUT THE PREFERRED EMBODIMENTS

A capacity variable device for a rotary compressor in accordance with the present invention and its operation method will now be described in detail with reference to accompanying drawings.

Figure 1:
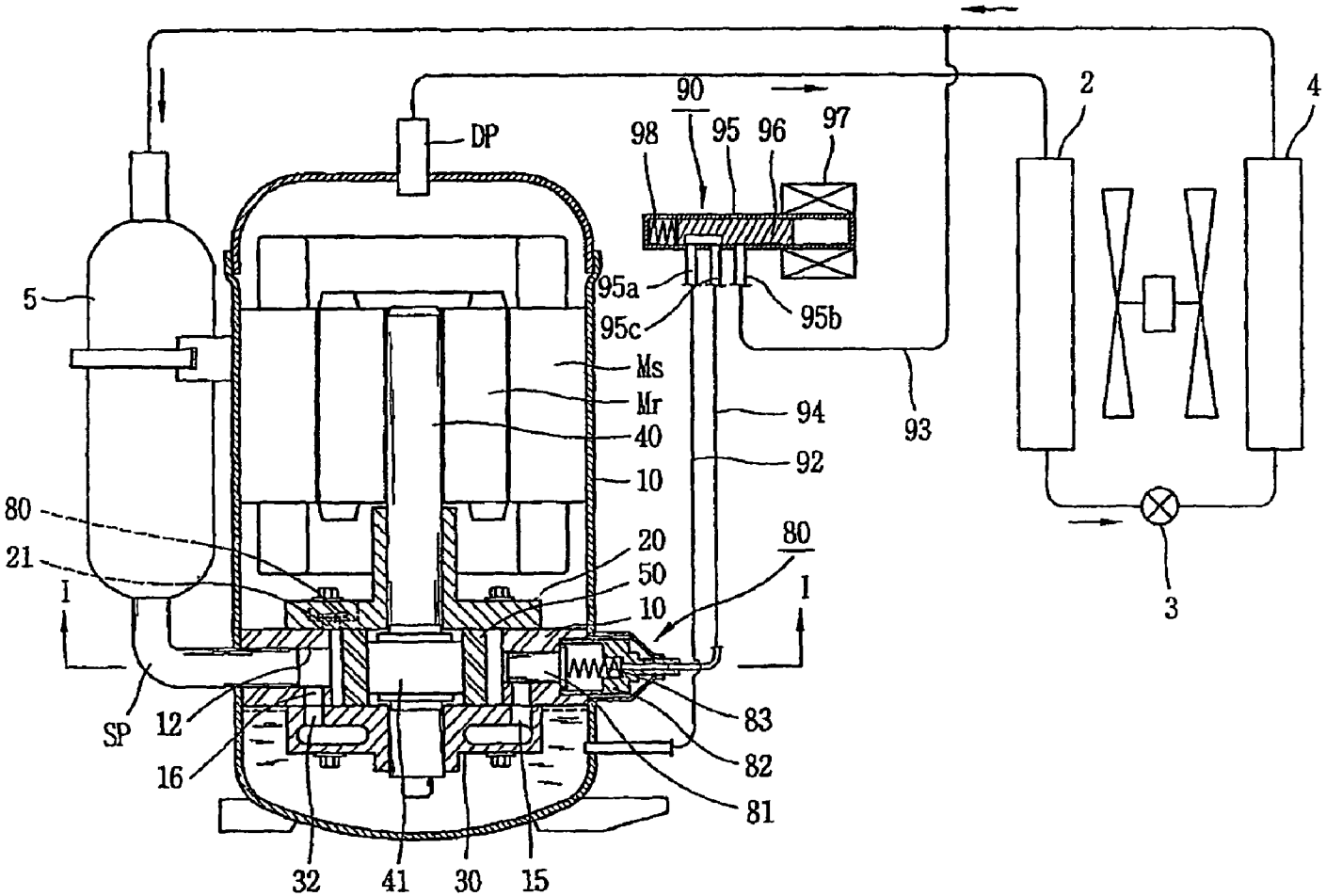
FIG. 1 is a block diagram that illustrates an air conditioner having a capacity variable type rotary compressor in accordance with one embodiment of the present invention.
Figure 2:
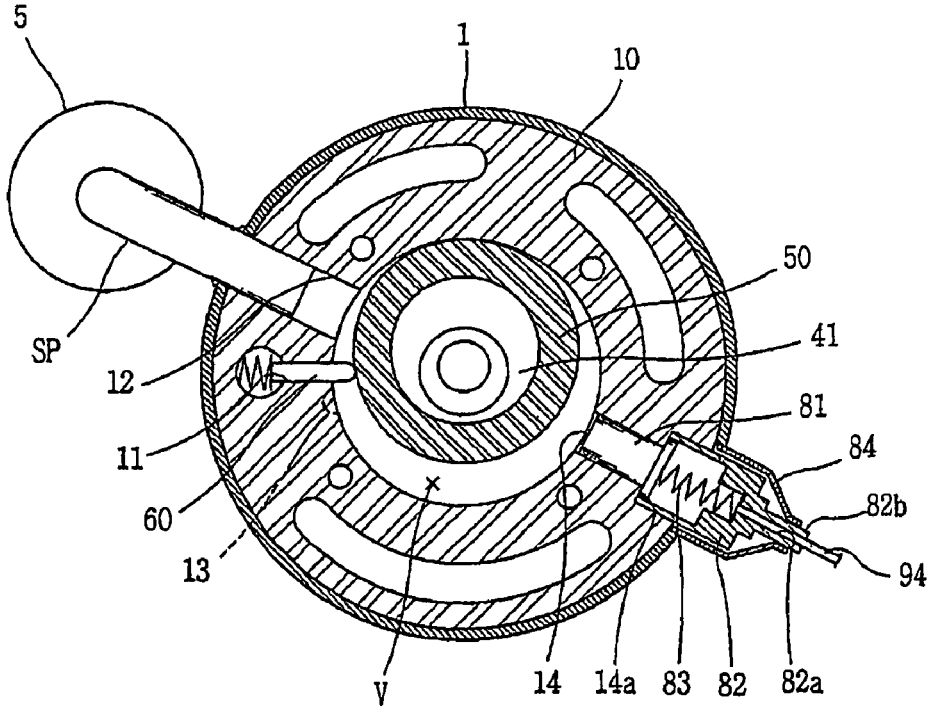
FIG. 2 is a sectional view taken along line I-I of FIG. 1.
Figure 3:
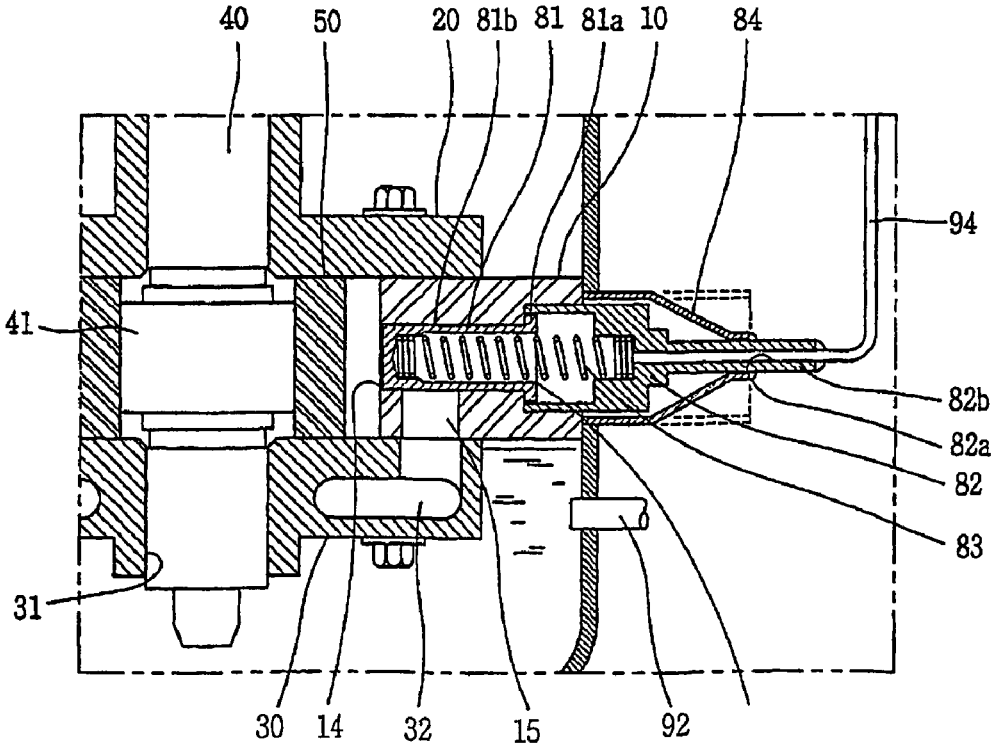
FIG. 3 is an assembled sectional view that illustrates a sliding valve of the capacity variable type rotary compressor in accordance with one embodiment of the present invention.
Figure 4:
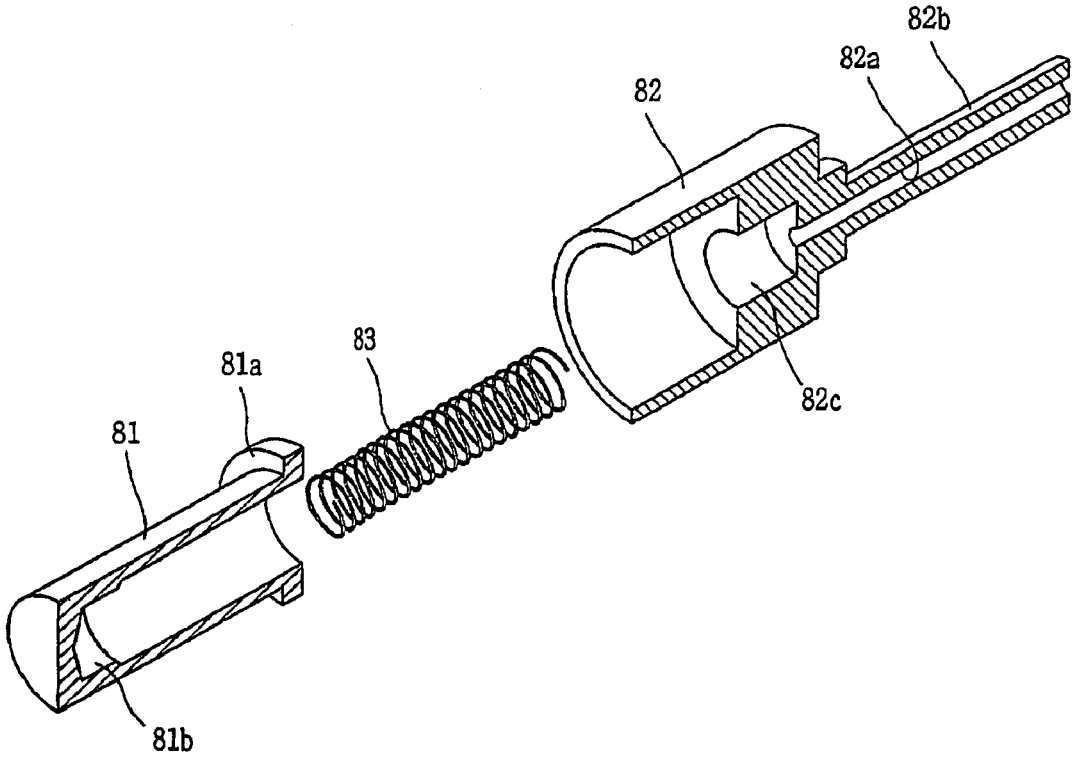
FIG. 4 is an exploded perspective view that illustrates the sliding valve of the capacity variable type rotary compressor in accordance with one embodiment of the present invention.
Figure 5:
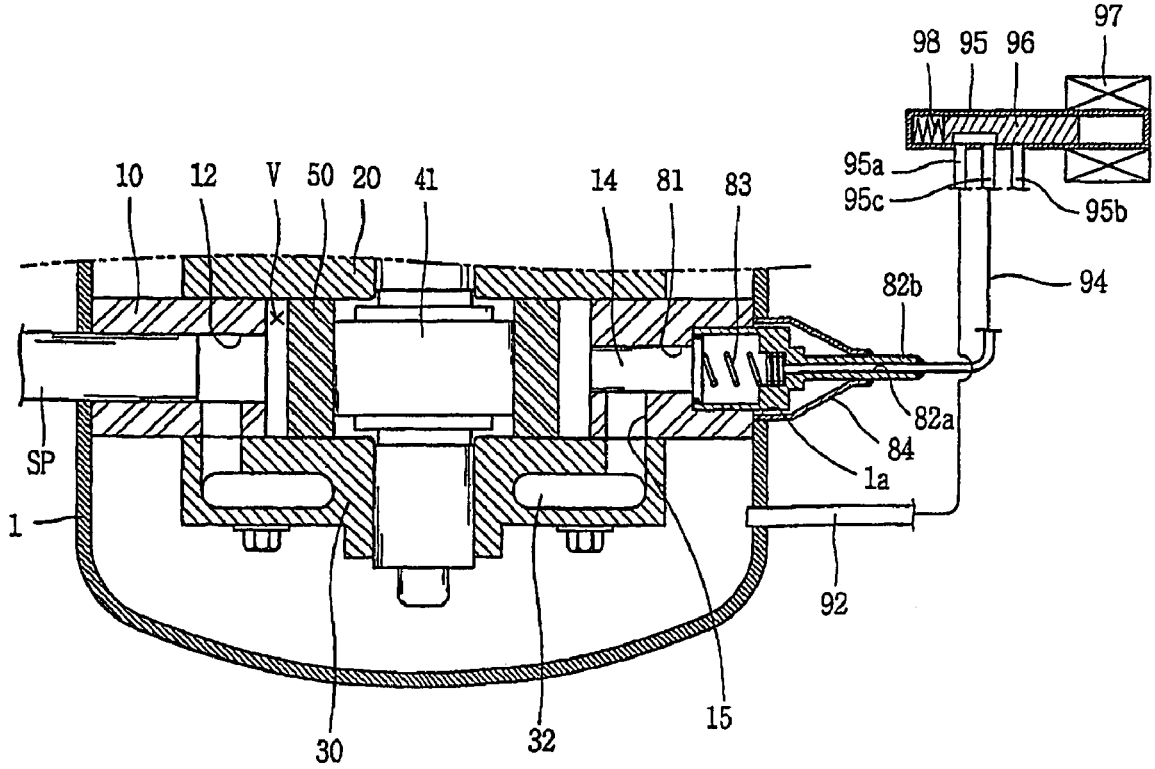
FIG. 5 is a view that illustrates a process of the capacity filled operation of the capacity variable type rotary compressor in accordance with one embodiment of the present invention.
Figure 6:
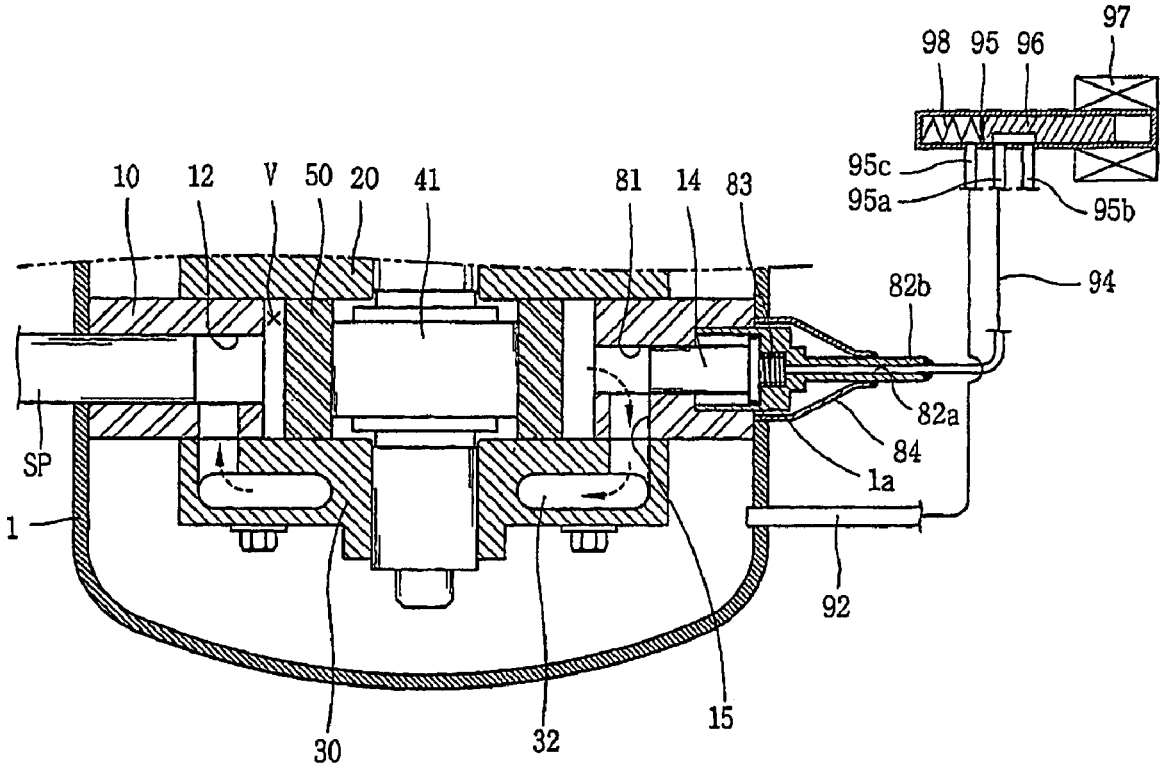
FIG. 6 is a view that illustrates a process of the capacity exclusion operation in the capacity variable type rotary compressor in accordance with one embodiment of the present invention.
Figure 7:
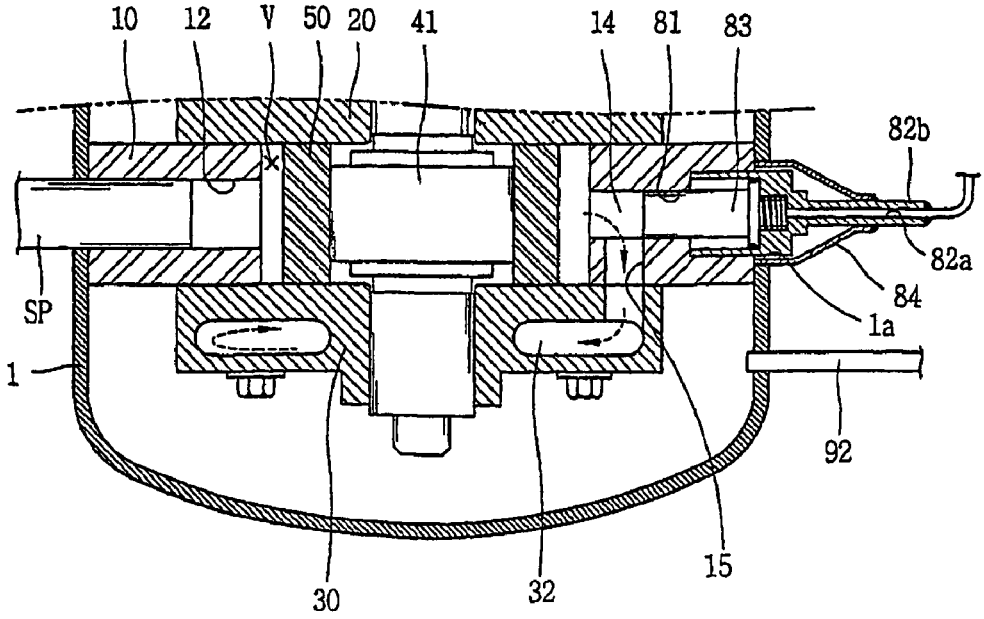
FIG. 7 is a sectional view that illustrates the capacity variable type rotary compressor in accordance with another embodiment of the present invention.
Figure 8:
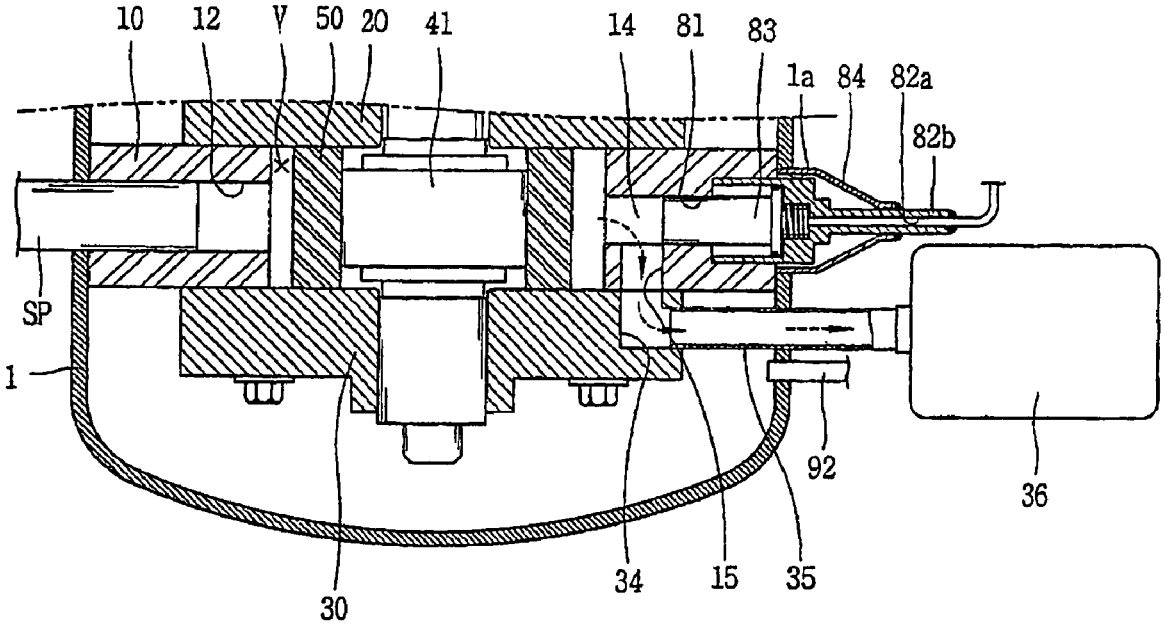
FIG. 8 is a sectional view that illustrates the capacity variable type rotary compressor in accordance with still another embodiment of the present Invention.
Figure 9:
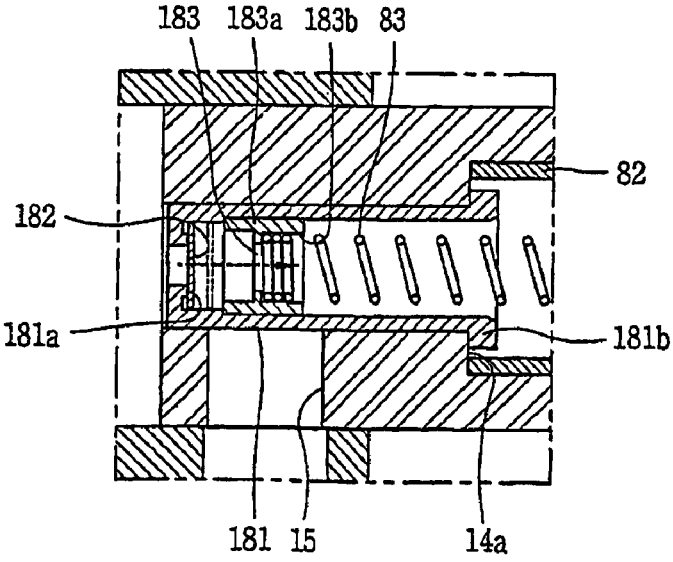
FIGS. 9 and 10 are a sectional view and an exploded perspective view that illustrate a modified example of the sliding valve of the capacity variable type rotary compressor in accordance with the present invention.
Figure 10:
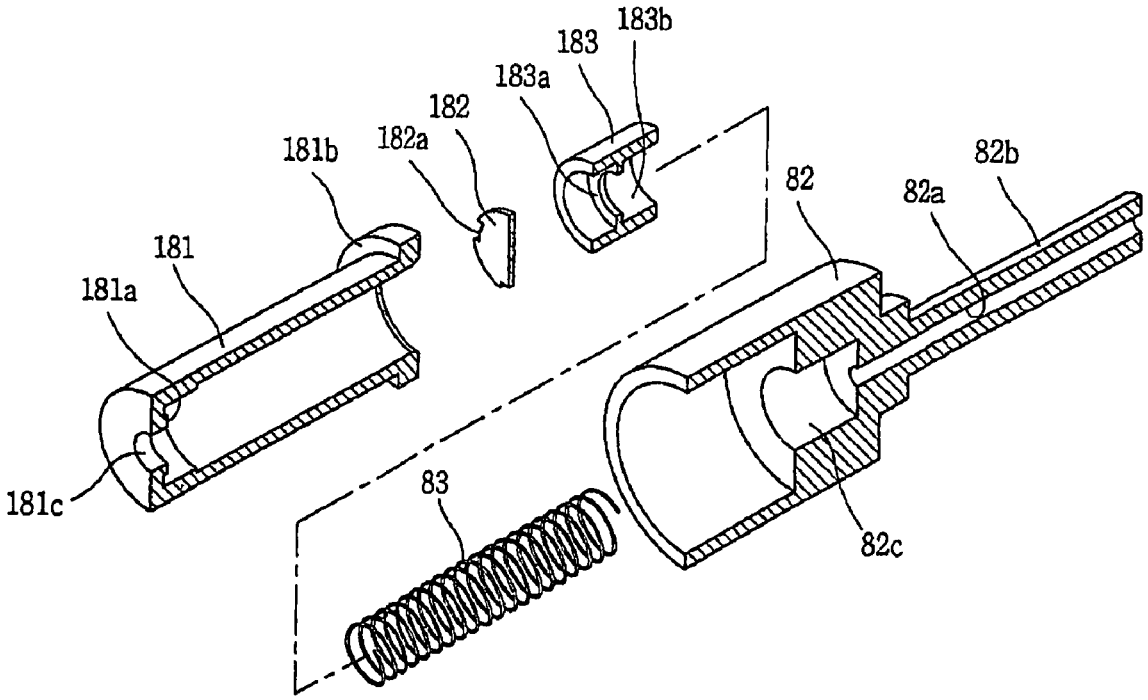
Figure 11:
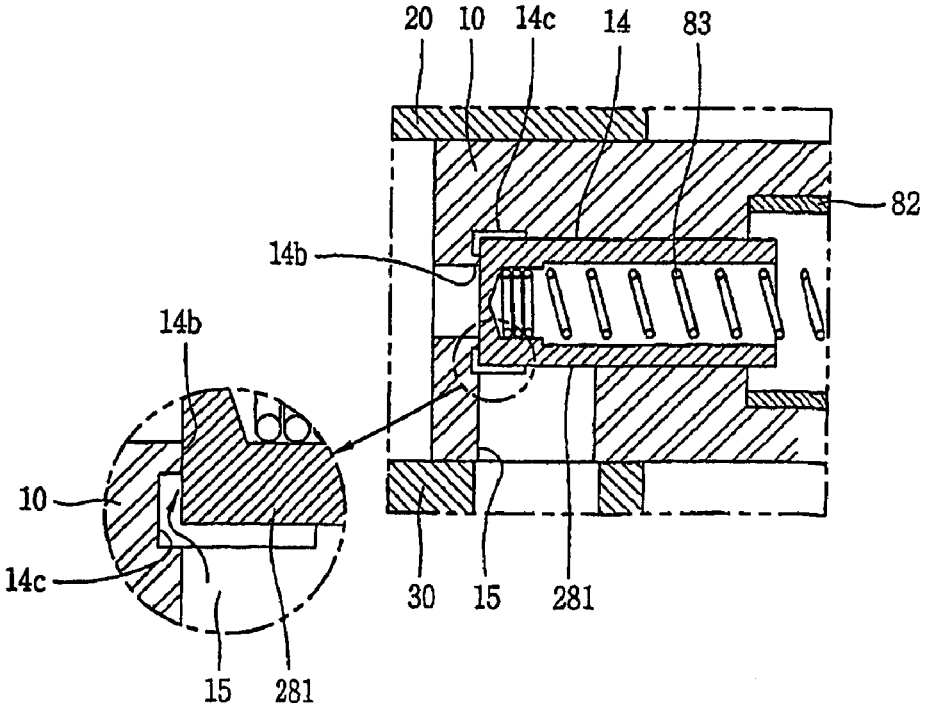
FIGS. 11 and 12 are a sectional view and an exploded perspective view that illustrate another modified example of the sliding valve of the capacity variable type rotary compressor in accordance with the present invention.
Figure 12:
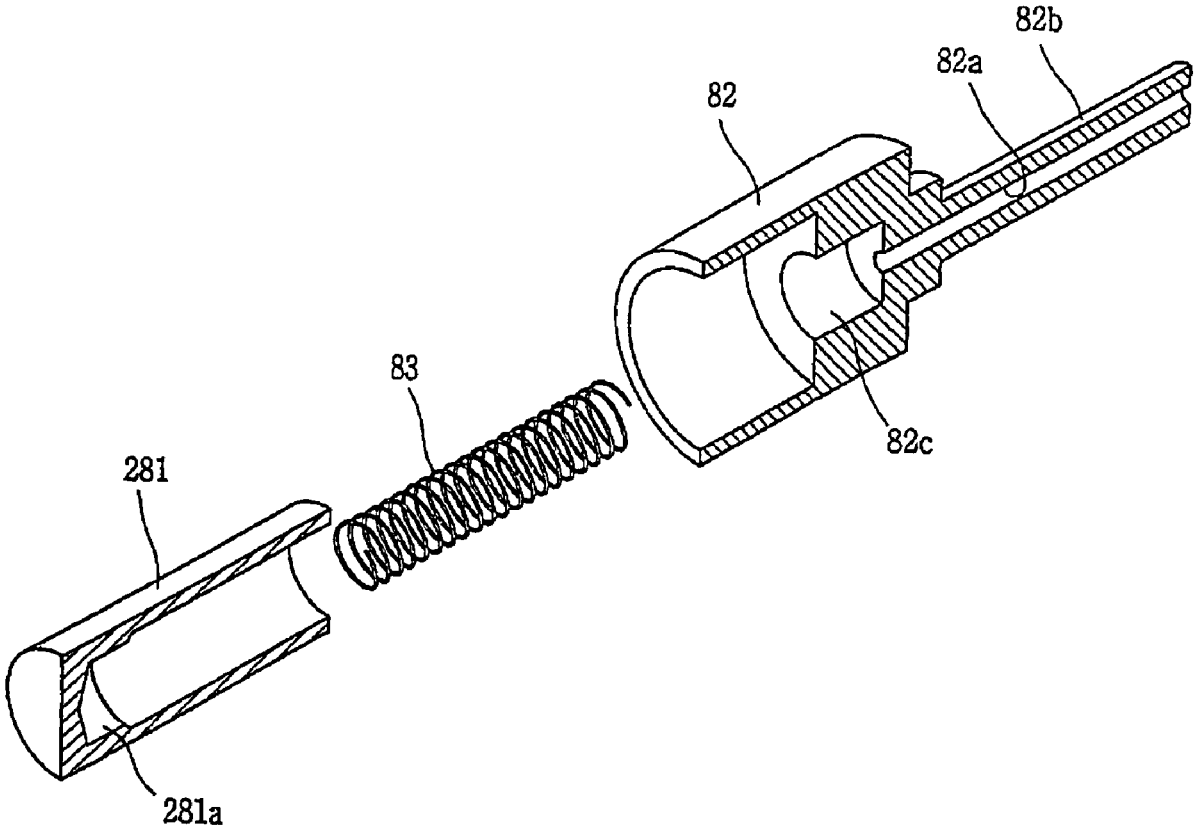
Figure 13:
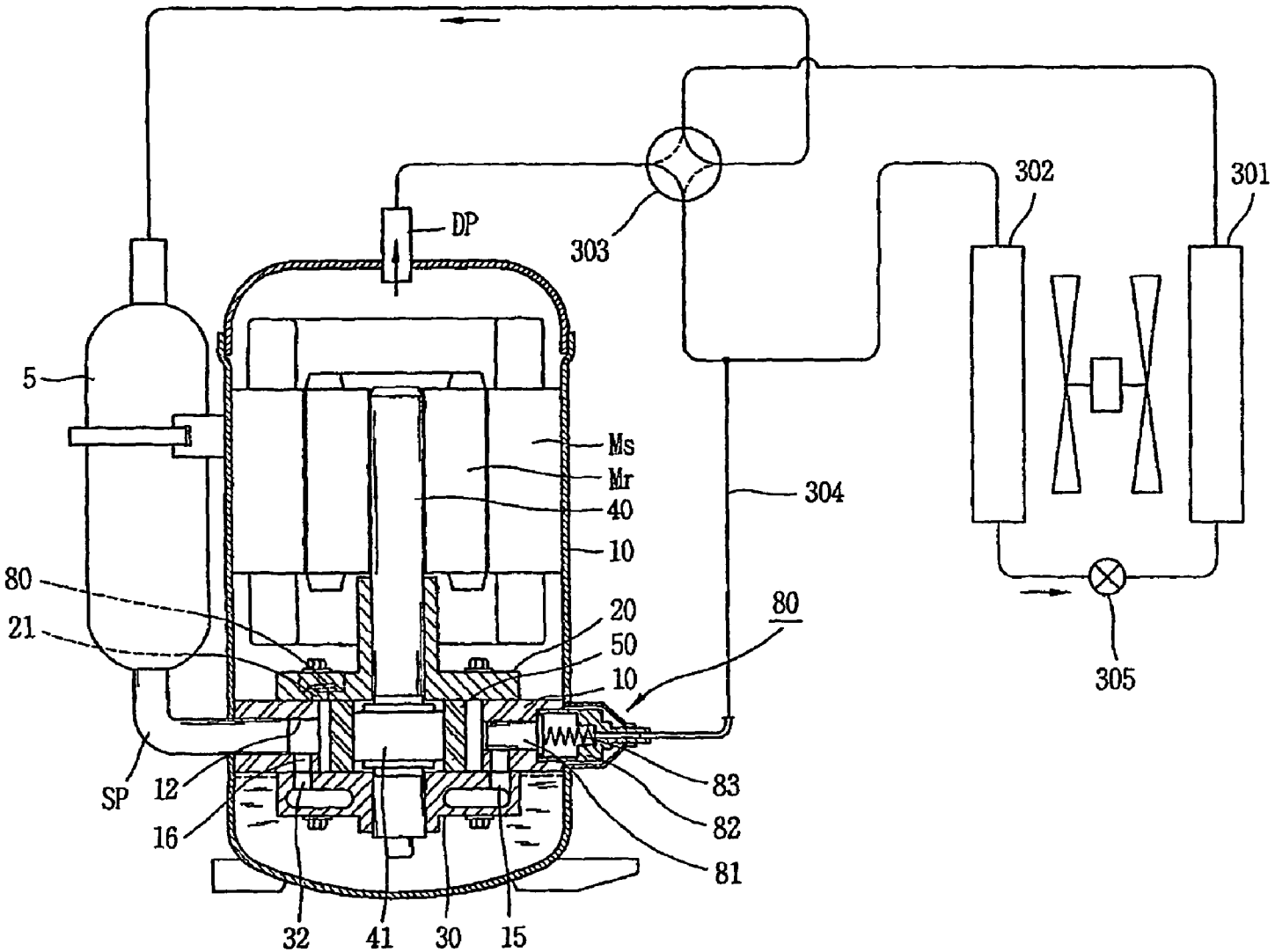
FIG. 13 is a block diagram of an air conditioner employing another embodiment of a back pressure switching unit of the capacity variable type rotary compressor in accordance with the present invention.
Figure 14:
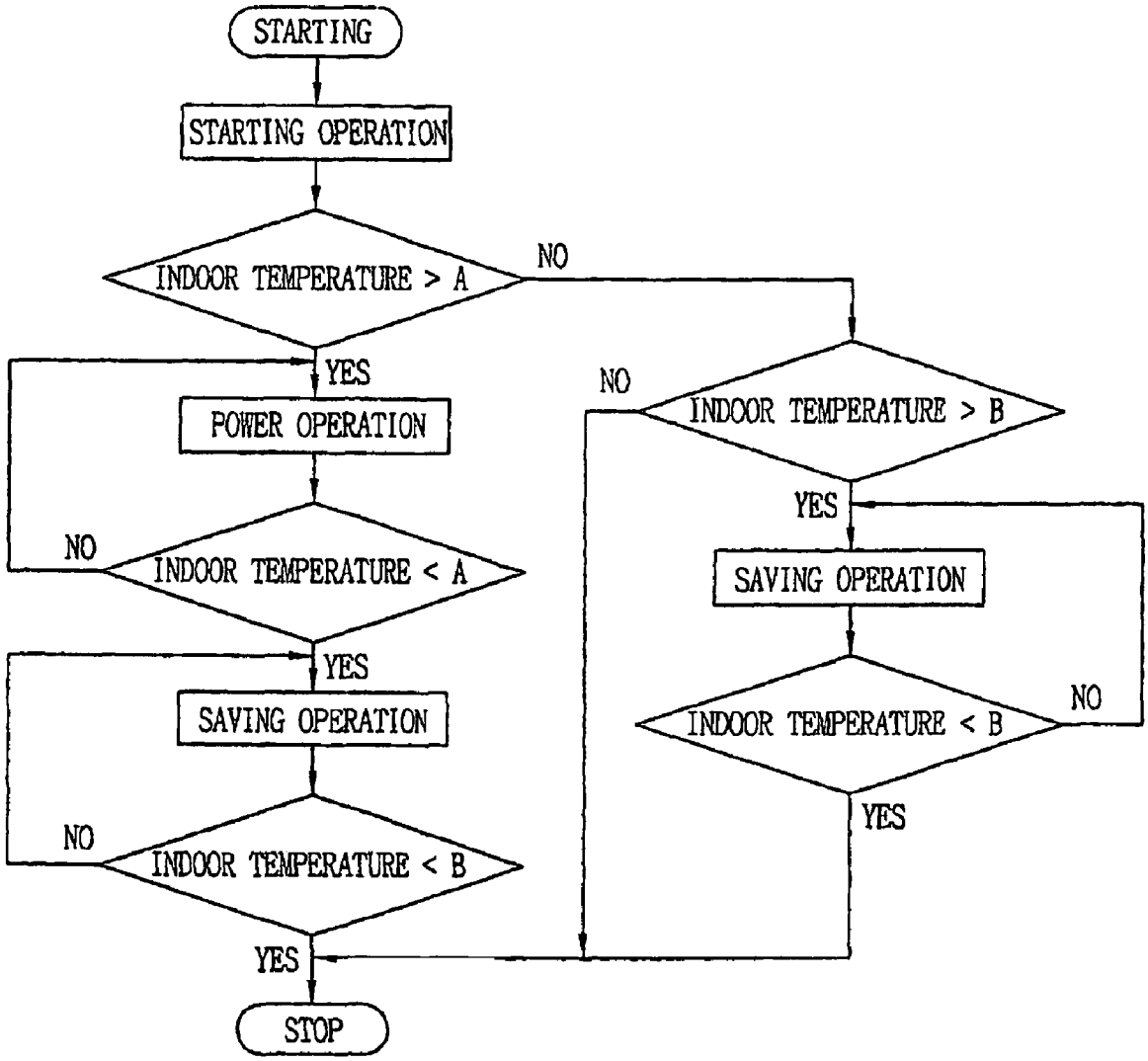
FIG. 14 is a flow chart of an air conditioner using the capacity variable type rotary compressor in accordance with the present invention.

FIG. 1 is a block diagram that illustrates an air conditioner having a capacity variable type rotary compressor in accordance with one embodiment of the present invention, FIG. 2 is a sectional view taken along line I-I of FIG. 1, FIG. 3 is an assembled sectional view that illustrates a sliding valve of the capacity variable type rotary compressor in accordance with one embodiment of the present invention, FIG. 4 is an exploded perspective view that illustrates the sliding valve of the capacity variable type rotary compressor in accordance with one embodiment of the present invention, FIG. 5 is a view that illustrates a process of the capacity filled operation of the capacity variable type rotary compressor in accordance with one embodiment of the present invention, FIG. 6 is a view that illustrates a process of the capacity exclusion operation in the capacity variable type rotary compressor in accordance with one embodiment of the present invention, FIG. 7 is a sectional view that illustrates the capacity variable type rotary compressor in accordance with another embodiment of the present invention, FIG. 8 is a sectional view that illustrates the capacity variable type rotary compressor in accordance with still another embodiment of the present invention, FIGS. 9 and 10 are a sectional view and an exploded perspective view that illustrate a modified example of the sliding valve of the capacity variable type rotary compressor in accordance with the present invention, FIGS. 11 and 12 are a sectional view and an exploded perspective view that illustrate another modified example of the sliding valve of the capacity variable type rotary compressor in accordance with the present invention, FIG. 13 is a block diagram of an air conditioner employing another embodiment of a back pressure switching unit of the capacity variable type rotary compressor in accordance with the present invention, and FIG. 14 is a flow chart of an air conditioner using the capacity variable type rotary compressor in accordance with the present invention.

As shown in FIG. 1, the rotary compressor in accordance with the present invention includes a casing 1 connected to a gas intake pipe (SP) and a gas discharge pipe (DP), a motor unit installed at an upper side of the casing 1 and generating a rotating force, and a compressor unit installed at a lower side of the casing 1 and compressing a refrigerant by the rotating force generated from the motor unit.

The motor unit includes a stator (Ms) fixed inside the casing 1 and receiving power from the outside, and a rotor (Mr) disposed inside the stator (Ms) with a certain gap therewith and rotating, interworking with the stator Ms).

The compressor unit includes a cylinder 10 having an annular shape and installed inside the casing 1, a main bearing plate (main bearing) 20 and a sub-bearing plate (sub-bearing) 30 covering both upper and lower sides of the cylinder 10 and forming an internal space (V) together, a rotary shaft 40 pressingly inserted in the rotor (Mr), supported by the main bearing 20 and the sub-bearing 30 and transferring a rotating force, a rolling piston 50 rotatably coupled to an eccentric portion 41 of the rotary shaft 40 and compressing a refrigerant while orbiting within the internal space of the cylinder 10, a vane 60 coupled to the cylinder 10 movably in a radial direction so as to pressingly contact with an outer circumferential surface of the rolling piston 50 and dividing the internal space m of the cylinder 10 into an intake chamber and a compression chamber, and a discharge valve 70 openably and closably coupled to a front end of a discharge port 21 provided at a central portion of the main bearing 20 and limiting a refrigerant gas being discharged from the compression chamber.

Also, the compressor unit further includes a capacity varying unit 80 provided at one side of the cylinder 10 and varying the capacity of the compression chamber and a back pressure switching unit 90 connected to the capacity varying unit 80 and operating the capacity varying unit 80 by a pressure difference due to an operation mode of the compressor.

As shown in FIGS. 1 to 3, the cylinder 10 formed as an annular shape so as to allow the rolling piston 50 to make a relative motion, and includes a vane slit 11 linearly formed at its one side to allow the vane 60 to linearly move in a radial direction, an intake hole 12 penetratingly formed at one side of the vane slit 11 in a radial direction and communicating with the gas intake pipe (SP), a discharge guide groove 13 formed at the other side of the vane slit 11 and communicating with the discharge port 21 of the main bearing 20 to induce discharge of the refrigerant gas, a valve hole 14 formed at one side of the vane slit 11 and directing outside the cylinder 10, a portion of a refrigerant gas compressed in the cylinder, a bypass hole 15 penetratingly formed under the valve hole 14 In an axial direction and communicating with the valve hole 14 so as to exclude a refrigerant, and a communication hole 16 formed at an opposite side of the bypass hole 15 and allowing a gas flow path 32 (to be described later) of the sub-bearing 30 to be in communication with the intake hole 12.

Preferably, the valve hole 14 is formed at a place where cylinder pressure of its inlet end becomes lower than internal pressure of the casing 10, namely, within a range of about 170~200°, more particularly, about 180~190° from the intake hole 12 in a direction in which the rotating piston rotates, and has a diameter which corresponds to approximately 30~55% of the height of the cylinder 10. Thusly, the cooling capability in the capacity exclusion operation can be varied up to about 50%, and the efficiency degradation of the compressor can be prevented.

Also, preferably, in order to reduce flow path resistance of the excluded refrigerant gas, a diameter of the bypass hole 15 may be the same as or greater than that of the valve hole 14.

The sub-bearing 30 has a disc shape having at its center, a bearing hole 31 supporting the rotary shaft in a radial direction and includes therein a gas flow path 32 allowing the bypass hole 15 of the cylinder 10 to be in communication with the communication hole 16.

As shown in FIGS. 1 to 3, the gas flow path 32 may penetrate the inside of the sub-bearing 30. However, as occasion demands, the gas flow path 32 may be recessed at a portion of the sub-bearing 30 contacting with a lower surface of the cylinder 10, namely, at an upper surface of an outer side of a sub-bearing surface.

As shown in FIG. 7, the sub-bearing 30 may have a gas storage groove 33 that communicates with the bypass hole 14, temporarily stores an excluded refrigerant gas and allows the refrigerant gas to flow back to the cylinder 10 when the rolling piston 50 passes through the valve hole 14.

To this end, a valve hole 14 is formed at one side of the intake hole 12 of the cylinder 10 in a radial direction, and the bypass hole 15 is formed in the middle of the valve hole 14 in an axial direction to communicate with the gas storage groove 33.

Here, the gas storage groove 33 may be formed inside the sub-bearing 30. More preferably, the gas storage groove 33 is recessed at a portion of the sub-bearing contacting with a lower surface of the cylinder 10 for the purpose of facilitating a manufacturing process. Also, the volume of the gas storage groove 33 is preferably formed corresponding to approximately 50% of the cylinder volume so as to prevent compression of the refrigerant, which is stored after bypassing the cylinder.

Also, a gas storage space may be formed at an outer edge of the sub-bearing 30. Namely, as shown in FIG. 8, a guide hole 34 is penetratingly formed at an outer circumferential surface of the sub-bearing 30 so as to be in communication with the bypass hole 34 of the cylinder 10, a connection pipe 35 passing through the casing 10 is connected to an outlet side of the guide hole 34, and a gas storage container 36 having a predetermined volume is connected to an end of the connection pipe 35.

Here, preferably, the internal volume of the gas storage container 36 is greater than 50% of the cylinder volume in order to prevent the compression of a refrigerant, which is stored after bypassing the cylinder.

As shown in FIGS. 3 and 4, the capacity varying unit 80 includes a sliding valve 81 slidingly inserted in the valve hole 14 of the cylinder 10 and opening and closing the bypass hole 15, a valve stopper 82 placed at a rear side of the sliding valve 81, fixed to an outer diameter of the valve hole 14 and limiting a movement of the sliding valve 81, and a valve spring 83 interposed between the sliding valve 81 and the valve stopper 82 and elastically supporting the sliding valve 51.

The sliding valve 81 is formed as a cylindrical body such that one end (a front end) of the sliding valve 81 adjacent to an inner-diameter of the cylinder 10 is closed to block the valve hole 14, and at an outer circumferential surface of its other end (a rear end), a stopping protrusion 81*a* is protrudingly formed to limit a moving distance of the valve 81 by being caught by a valve stopping protrusion 14*a* provided at an inner circumferential surface of an outer diameter side of the valve hole 14.

Also, a spring fixing end 81*b* is steppingly formed at an inner circumferential surface of the front end of the sliding valve 81 to fix the valve spring 83, and the valve stopping protrusion 81*a* is formed as a cylindrical shape or an a circular arc shape.

Also, preferably, the sliding valve 81 has a length long enough to allow an outer surface of its front end to almost align with an inner circumferential surface of the cylinder 10 when the sliding valve 81 is closed, or has a length long enough to allow the sliding valve 81 to be covered by the valve hole 14 to an extent of 0.1~0.5 mm, such that a dead volume and leakage of the compression gas can be prevented.

The valve stopper 82 has at its center, a back pressure hole 82*a* communicating with the valve hole 14 and connected to a common connection pipe 94 of the back pressure switching unit 90 to be described later, by extendingly forming a back pressure pipe portion at the outer surface of the valve stopper 82. A spring fixing groove 82*c* is recessed at the center of an inner surface of the valve stopper 82 so that the other end of the valve spring 83 can be pressingly inserted and fixed thereto. Preferably, the spring fixing groove 82*c* is formed to be in communication with the back pressure hole 82*a*.

Here, preferably, a through hole 1*a* is formed at the casing 1 to communicate with the valve hole 14, and the sliding valve 81, the valve spring 83 and the valve stopper 82 are assembled through the through hole 1*a*, and then, a stopper support pipe 84 is installed to support the valve stopper 82. Preferably, in order to minimize introduction of welding heat, an outer end of the stopper support pipe 84 is puckered after the assembly of the valve stopper 82 and then, is coupled to the back pressure pipe portion 82*b* by welding.

As shown in FIGS. 9 and 10, the sliding valve 181 may be formed as a cylindrical body whose both sides are opened. In such a case, a plate-shaped sub-valve 182 blocking the valve hole 14 and excluding a portion of a compression gas when over-compression occurs in the cylinder is installed at the front end of the sliding valve 181.

To this end, a valve stopping protrusion 181*a* for preventing separation of the sub-valve 182 is protrudingly formed at an inner circumferential surface of the front end of the sliding valve 181, a sub-valve stopper 183 limiting a moving distance of the sub-valve 182 is pressingly inserted to a rear surface side of the sub-valve 182, and the sub-valve 182 is interposed between the valve stopping protrusion 181 a and the sub-valve stopper 183.

The sub-valve 182 is formed as a circular plate shape so as to slidingly contact with an inner circumferential surface of the valve hole 14 and has at its outer circumferential surface, a gas passing groove 182*a* for excluding a compression gas.

The sub-valve stopper 183 has an annular shape to have a gas passing hole 183*a* at its center, and preferably, one end of the valve spring 83 is pressingly. Inserted and fixed to the spring fixing end 183*b* provided at a side of the gas passing hole 183*a*.

Here, a stopping protrusion 181*b* is formed at an outer circumferential surface of a rear side of the sliding valve 181 as an annular shape or a circular arc shape, such that the movement of the sliding valve toward the front is limited as the protrusion 181*b* is caught by the valve stopping protrusion 14*a* of the valve hole 14.

As shown in FIGS. 11 and 12, a sliding valve 281 is formed as a cylindrical body having a closed front end and an opened rear end, and a movement of the sliding valve 281 may be limited as the front end is caught by the valve hole 14. In such a case, preferably, a valve stopping protrusion 14*b* having an annular shape and limiting a movement of the sliding valve 281 is formed at an inner circumferential surface of an end of the valve hole 14 close to the cylinder. Also, preferably, a communication groove 14*c* is formed between the valve stopping protrusion 14*b* and the bypass hole 15, such that an edge of the front end of the sliding valve 281 is within a range of a low pressure portion.

As shown in FIG. 1, a back pressure switching unit 90 includes a switching valve assembly 91 determining pressure of a rear side of the sliding valve 81, a high-pressure connection pipe 92 connecting the inside of the casing 1 to a high-pressure side inlet of the switching valve assembly 91, a low-pressure connection pipe 93 connecting the middle portion of the gas suction pipe (SP) to a low-pressure side inlet of the switching valve assembly 91 and supplying a low-pressure atmosphere, and a common connection pipe 94 connecting a common side outlet 95*c* of the switching valve assembly 91 to a rear side of the sliding valve 81 and supplying a high-pressure atmosphere or a low-pressure atmosphere.

The switching valve assembly 91 is a kind of a pilot valve, and includes a switching valve housing 95 having a high pressure side inlet 95*a*, a low-pressure side inlet 95*b* and a common side, outlet 95*c*, a switching valve 96 slidingly coupled with the inside of the switching valve housing 95 and selectively connecting the high pressure side inlet 95*a* or the low pressure side inlet 95*b* with the common side outlet 95*c*, an electromagnet 97 installed at one side of the switching valve housing 95 and moving the switching valve 96 by applied power, and a compression spring 98 returning the switching valve 96 to an initial position when the power applied to the electromagnet 97 s cut off.

An inlet end of the high pressure connection pipe 92 may be connected to a lower portion of the casing 1 and submerged by oil within the casing in order to form a high-pressure atmosphere at the rear surface of the sliding valve 81 of the capacity varying unit 80 and to supply oil to the capacity varying unit 80. The inlet end of the high pressure connection pipe 92 may be connected to an upper portion of the casing 1 in order to form a high pressure atmosphere by providing a high-pressure discharge gas.

Undescribed reference numeral 181*c* is a gas passing hole, and 281*a* is a spring fixing end.

The operational effect of the capacity varying device of the rotary compressor in accordance with the present invention will now be described. When power is applied to the motor unit, the rotary shaft 41 rotates, and the rolling piston 50 orbits within the internal space M of the cylinder 11, forming a volume with the vane 60, such that a refrigerant gas is taken in, compressed and discharged to the casing 1. The refrigerant gas is discharged to a condenser 2 of a cooling cycle apparatus through the gas discharge pipe (DP), passes through an expansion mechanism 3 and the evaporator 4 in order, and then is taken into the internal space (V) of the cylinder 10 through the gas intake pipe (SP). Such processes are repeatedly performed.

Here, the capacity variable type compressor is operated in a capacity exclusion operation mode or a capacity filled operation mode according to an operational state of an air conditioner employing the capacity variable type compressor.

First, as shown in FIG. 5, in the capacity filled operation mode, by applying power to the electromagnet 97 of the back pressure switching unit 90, which is a pilot valve, the switching valve 96 overcomes the switching valve spring 98 and moves to allow the high pressure side inlet 95*a* and the common side outlet 95*c* to communicate with each other. Then, a high-pressure refrigerant or oil is introduced to the back pressure hole 82*a* of the valve stopper 82 through the high pressure connection pipe 92 connected to the casing, the switching valve housing 95 and the common connection pipe 94. Thusly, the sliding valve 81 overcomes an elastic force of the valve spring 83, an expansion spring, and advances to block the bypass hole 15, so that the refrigerant compressed within the internal space (V) of the cylinder 10 is compressed as it is and is discharged to the casing 1.

Here, because the stopping protrusion 81*a* formed at the rear end of the sliding valve 81 is caught by the valve stopping protrusion 14*a* of the valve hole 14 to stop the valve 81 in a state that the front end surface of the valve 81 is placed on almost the same plane with the inner circumferential. surface of the cylinder 10, the leakage of the compression gas can be prevented as much as possible while orbiting of the rolling piston 50 is not interrupted. Also, if oil is introduced through the high-pressure connection pipe 92, the oil not only lubricates a sliding surface of the sliding valve 81 to thereby prevent abrasion but also fills up gaps between members to thereby prevent leakage of a compression gas and reduce vibration. Accordingly, reliability and performance of the compressor can be improved.

Here, a valve shaking phenomenon may occur while the compressor is in the capacity filled operation mode. The valve shaking phenomenon is a phenomenon in which the sliding valve 81 is subtly shaken because the pressure of the internal space (V) of the cylinder 10 is excessively increased by overcompression, and a section where a force obtained by adding the pressure of the cylinder 10 to a restoration force of the valve spring 83 is greater than the pressure being supplied to the rear surface of the sliding valve 81 is generated. In such case, the stopping protrusion 81*a* of the sliding valve 81 strongly collides with the valve stopping protrusion 14*a* of the valve hole 14, which may increase noise of the compressor.

The sliding valve 181 shown in FIGS. 9 and 10 proposed in consideration of such problems, excludes a portion of the compression gas as the sub-valve 182 provided therein is pushed by the pressure of the cylinder side and momentarily separated from a belt seat surface of the sliding valve 181. Thusly, the sliding valve 181 maintains its close attachment to the valve stopping protrusion 14*a* of the valve hole 14, thereby preventing valve noise of the sliding valve 181.

Also, the sliding valve 281 of FIGS. 11 and 12 can be prevented from being shaken because an area of a front end surface of the sliding valve 28 exposed to the internal space (V) of the cylinder 10 is decreased by an area occupied by the communication groove 14*c*, namely, by its area covered by the valve stopping protrusion 14*b*. Thusly, even though the compressor excessively performs a compression operation, because an area pressurized by a compressed refrigerant is decreased, the valve noise, which may occur while the sliding valve 10 is pushed during the capacity filled operation, can be prevented.

Then, in the capacity exclusion operation, as shown in FIG. 6, power applied to the electromagnet 97 of the back pressure switching unit 90, which is a pilot valve, is cut off, so that the switching valve 96 is pushed back by the switching valve spring 98 to allow communication between the low-pressure inlet 95*b* and the common side outlet 95*c*. Then, a low pressure refrigerant being received into the gas intake pipe (SP) from the evaporator 4 is introduced to the back pressure hole 82*a* of the valve stopper 92 through the common connection pipe 94. Thusly, the sliding valve 81 is moved back by a restoration force of the valve spring 83 which is an expansion spring, such that the bypass hole 15 is opened and a portion of a refrigerant compressed in the internal space (V) of the cylinder 10 is excluded through the bypass hole 15. The excluded refrigerant moves to the intake hole 12 through the gas flow path 32 of the sub-bearing 30 and the communication hole 16 of the cylinder so as to be retaken into the internal space (V) of the cylinder 10. Also, the excluded refrigerant may be temporarily stored within the gas storage groove 33 of the sub-bearing 30 shown in FIG. 7 or within the gas storage container 36 placed outside the casing as shown in FIG. 8, and flow back into the internal space m of the cylinder 10 when the rolling piston 50 passes therethrough. Accordingly, the compressor structure can be simplified while the capacity of the compressor may be lowered by approximately 50%, such that various operation modes can be implemented and the efficiency of the compressor can be improved.

In case of an air conditioner that uses a four-way valve and performs both cooling and heating operations, a bypass pipe diverging from a middle portion of a refrigerant pipe may be connected to a back pressure pipe portion of the valve stopper, namely, a rear surface of the sliding valve, without specially using the pilot valve in the compressor structure.

Namely, as shown in FIG. 13, the bypass pipe 304 diverges from the middle portion of a refrigerant pipe between the indoor unit 302 or the outdoor unit and the four-way valve 303 placed between the outdoor unit 301 and the indoor unit 302 (e.g., in the drawing, the refrigerant pipe of the indoor unit), and is connected to the back pressure hole 82*a* of the valve stopper 82.

For example, if the bypass pipe 304 diverges from the refrigerant pipe between the four-way valve 303 and the indoor unit 302, a portion of a refrigerant is introduced into the back pressure pipe portion 82*b* in a state that its pressure is lowered while the refrigerant passes through the indoor unit 302 functioning as an evaporator during a cooling operation. However, because the pressure of the refrigerant introduced into the back pressure pipe portion 82*b* is lower than the pressure of the cylinder 10, the sliding valve 81 moves back, allowing the capacity exclusion operation. During a heating operation, a portion of a refrigerant in a high pressure state is introduced to the back pressure pipe portion 82*b* through the bypass pipe 304 before being introduced into the indoor unit 302 functioning as a condenser, thereby moving forward the sliding valve 81 and thusly blocking the bypass hole 15.

Thusly, the compressor is automatically operated in the capacity filled operation mode Although not shown in the drawing, if the bypass pipe diverges from a refrigerant pipe between the four-way valve and the outdoor unit, the operation is made in an opposite manner to the aforementioned one. Namely, the compressor is operated in the capacity filled operation mode during the cooling operation, and during the heating operation, the compressor is operated in the capacity exclusion operation mode.

As shown in FIG. 14, the air conditioner employing the compressor in accordance with the present invention can be operated in the manner described in FIG. 14. First, at a starting stage of the air conditioner, the compressor is controlled to be in the capacity exclusion operation mode (starting operation mode) for a certain period of time. Here, the control unit detects a temperature of the indoor unit and determines whether the indoor unit temperature is higher than a set temperature (A). If the indoor unit temperature is higher than the set temperature (A), the compressor is controlled to be in the capacity filled operation mode (power operation mode) while, if the indoor unit temperature is lower than the set temperature (A) and higher than a set temperature (B), the compressor is controlled to keep operating in the capacity exclusion operation mode (saving operation mode).

Then, in a process of operating the compressor after converting its operation mode into the capacity filled operation mode because the indoor unit temperature is higher than the set temperature (A) in the previous step, the temperature of the indoor unit is continuously detected. In such a process, it is determined whether the indoor unit temperature is lower than the set temperature (A). If the indoor unit temperature is lower than the set temperature (A), the operation is converted again into the capacity exclusion operation mode (saving operation mode). However, if the indoor unit temperature is higher than the set temperature (A), the compressor is controlled to keep operating in the capacity filled operation mode (power operation mode). Here, as occasion demands, the compressor may be operated in the capacity filled operation mode and the capacity exclusion operation mode, alternately.

Then, in a process of operating the compressor after converting its operation mode into the capacity exclusion operation mode because the indoor unit temperature is lower than the set temperature (A) in the previous step, the temperature of the indoor unit is continuously detected. In such a process, it is determined whether the indoor unit temperature is lower than a set temperature (B). If so, the compressor is stopped. However, if the indoor unit temperature is still higher than the set temperature (B), the compressor is controlled to keep operating in the capacity exclusion operation mode (saving operation mode). Also, as occasion demands, the capacity exclusion operation and the stopping mode may be alternately performed.

Because the compressor is operated in the capacity exclusion operation mode when the air conditioner is started, a compression load is small, which facilitates the starting of the compressor, and the starting of the compressor 18 possible even when pressure balance between a high-pressure side and a low-pressure side is lost. Thusly, a time required for restarting can be shortened. Also, vibration of the compressor can be reduced during starting and reverse rotation of the rotary shaft due to reverse-flow of a compression gas can be prevented.

The capacity variable device for a rotary compressor and an operation method of an air conditioner having the same can be used to every device that requires a compressor, such as an air conditioner, a refrigerator, a showcase or the like.

It will be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

The invention claimed is:

1. A capacity variable device for a rotary compressor comprising:

a casing that is provided with a gas intake pipe communicating with an evaporator and a gas discharge pipe communicating with a condenser;

a cylinder that is fixedly installed inside the casing and has an intake hole penetratingly formed in a radial direction and directly communicating with a gas intake pipe, a valve hole penetratingly formed in a radial direction at a predetermined angle with respect to the intake hole, a bypass hole penetrating the middle portion of the valve hole in an axial direction and excluding a portion of a refrigerant, and a communication hole guiding to an intake chamber, the refrigerant excluded to the bypass hole;

a plurality of bearing plates that form an internal space by covering both upper and lower sides of the cylinder together, a discharge hole communicating with an internal space of the cylinder and discharging a compression refrigerant, and a gas flow path provided at at least one side of the plurality of bearing plates, the gas flow path connecting the bypass hole with the communication hole;

a rolling piston that is coupled to a rotary shaft of a driving motor rotating at a constant speed and compresses a refrigerant gas by a centrifugal force while orbiting within the cylinder;

a vane that is coupled to the vane slit of the cylinder movably in a radial direction to pressingly contact with an outer circumferential surface of the rolling piston and divides the internal space of the cylinder into an intake chamber and a compression chamber;

a sliding valve that is installed in the valve hole of the cylinder to slide in a radial direction and opens and closes the bypass hole of the cylinder, wherein the sliding valve is formed as a cylindrical body with both ends opened, wherein the sliding valve comprises a sub-valve at its end close to the cylinder so as to block the valve hole and exclude a portion of a compression gas when over-compression occurs within the cylinder, wherein the sub-valve is formed as a plate-shaped valve having a gas passing groove at its outer circumferential surface and sliding within the sliding valve, wherein a valve stopping protrusion that prevents a separation of the plate-shaped valve is formed at an inner circumferential surface of the sub-valve close to the cylinder, and wherein a sub-valve stopper limiting a distance that the plate-shaped valve moves is provided at a rear side of the plate-shaped valve; and a back pressure switching device that differentially supplies a back pressure to a rear surface of the sliding valve, such that the sliding valve slides within the valve hole according to an operation mode of the compressor to open and close the bypass hole.

2. The device of claim 1, wherein the valve hole is formed at a place where a cylinder pressure of its inlet end becomes lower than a pressure within the casing.

3. The device of claim 2, wherein the valve hole is formed such that its center is placed above the vane at a distance therebetween as long as 170~200 degrees from the vane in a direction that the rolling piston rotates.

4. The device of claim 2, wherein the valve hole has a diameter corresponding to approximately 30~055% of a height of the cylinder.

5. The device of one of claim 1, wherein the bypass hole has a diameter that is the same as or greater than a diameter of the valve hole.

6. The device of claim 1, wherein the gas flow path is formed by penetrating an inside of the plurality of bearing plates.

7. The device of claim 1, wherein the gas flow path is formed recessed in a contact surface of the plurality of bearing plates closely attached to the cylinder.

8. The device of claim 1, wherein a valve stopping protrusion is steppingly formed at a circumferential surface of a middle side of the valve hole, and wherein a stopping protrusion is formed at an outer circumferential surface of an open side of the sliding valve so as to limit a movement of the sliding valve by being caught by the valve stopping protrusion of the valve hole.

9. The device of claim 1, wherein a valve stopping protrusion is steppingly formed at a circumferential surface of an end of the valve hole close to the cylinder so as to limit a movement of the sliding valve as an end of the closed side of the sliding valve is caught thereby.

10. The device of claim 9, wherein a communication groove is recessed between the valve stopping protrusion and the bypass hole, such that a portion of a front end surface of the sliding valve close to the cylinder is within a pressure range of the bypass hole constituting a low-pressure portion.

11. The device of claim 1, wherein a valve stopper is provided at an outer diameter side of the valve hole of the cylinder so as to limit a separation of the sliding valve.

12. The device of claim 11, wherein the valve stopper includes a back pressure pipe portion which is extendingly formed, such that a back pressure hole communicating with the valve hole is formed at its center portion and is connected to the back pressure switching device.

13. The device of claim 12, wherein a through hole is formed at the casing that is co-linear with the valve hole, such that the sliding valve and the valve stopper are assembled outside the casing.

14. The device of claim 13, wherein a stopper support pipe is provided at the through hole of the casing so as to support the valve stopper.

15. The device of claim 14, wherein an outer end of the stopper support pipe is welded to be coupled to the back pressure pipe portion of the valve stopper by welding.

16. The device of claim 11, wherein an elastic member is interposed between the sliding valve and the valve stopper.

17. The device of claim 16, wherein the elastic member is an expansion spring so as to open the bypass hole by pulling the sliding valve toward the valve stopper when the pressure of a side of the sliding valve close to the cylinder and the back pressure are balanced.

18. The device of claim 1, wherein the back pressure switching device comprises:

a switching valve assembly determining pressure of a rear side of the sliding valve;

a high-pressure connection pipe connecting the inside of the casing with a high-pressure side inlet of the switching valve assembly and supplying a high-pressure a atmosphere;

a low-pressure connection pipe connecting a middle portion of the gas intake pipe to a low-pressure side inlet of the switching valve assembly and supplying a low-pressure atmosphere; and a common connection pipe connecting a common side outlet of the switching valve assembly to a rear side of the sliding valve and supplying a high-pressure atmosphere or a low-pressure atmosphere.

19. The device of claim 18, wherein the switching valve assembly comprises:

a switching valve housing having the high-pressure side inlet, the low-pressure side inlet and the common side outlet;

a switching valve slidingly coupled to the inside of the switching valve housing and selectively connecting the high-pressure side inlet or the low-pressure side inlet to the common side outlet;

an electromagnet installed at one side of the switching valve housing and moving the switching valve by an applied power; and an elastic member restoring the switching valve when the power applied to the electromagnet is cut off.

20. The device of claim 18, wherein the high-pressure connection pipe is connected to a lower portion of the casing so as to be immersed in oil filling the inside of the casing.

21. The device of claim 18, wherein the high-pressure connection pipe is connected to an upper portion of the casing so as to induce a refrigerant gas being discharged into the casing.

22. The device of claim 1, wherein the back pressure switching device comprises:

a four-way valve installed between an outdoor device and an indoor device and switching a flowing direction of a refrigerant; and a bypass pipe diverging from a middle portion of a refrigerant pipe connecting the four-way valve to the indoor device or the outdoor device and communicating with a rear surface of the sliding valve.

23. An operation method of an air conditioner provided with a capacity variable rotary compressor of claim 1, the method comprising:

a starting operation mode in which, when the rotary compressor including the bypass hole and the sliding valve opening and closing the bypass hole at the cylinder is started, the operation is performed while a portion of the compression gas within the cylinder is excluded through the bypass hole for a certain period of time;

a power operation mode in which the operation is performed in a state that the sliding valve blocks the bypass hole of the cylinder when a temperature of an indoor device is higher than a first set temperature during the starting operation mode upon comparison of the indoor device temperature with the first set temperature;

a saving operation mode in which the operation is performed while a portion of the compression gas is excluded by opening the bypass hole of the cylinder when the temperature of the indoor device is lower than the first set temperature during the power operation mode upon comparison of the indoor device temperature with the first set temperature; and a stopping mode in which the operation is stopped by turning off power when the temperature of the indoor device is lower than a second set temperature during the saving operation mode upon comparison of the indoor device temperature with the second set temperature.

24. The method of claim 23, wherein when the temperature of the indoor device is lower than the first set temperature in the starting operation mode, the temperature of the indoor device is compared with the second set temperature, and when the temperature of the indoor device is higher than the second set temperature, the starting operation mode is continued while when the temperature of the indoor device is lower than the second set temperature, the stopping mode is carried out.

25. The method of claim 23, wherein when the temperature of the indoor device is still higher than the first set temperature in the power operation mode, the power operation mode is continuously carried out.

26. The method of claim 23, wherein when the temperature of the indoor device is still higher than the second set temperature in the saving operation mode, the operation is made in the power operation mode.

* * * * *

UNITED STATES PATENT AND TRADEMARK OFFICE

CERTIFICATE OF CORRECTION

PATENT NO. : 7,931,453 B2
APPLICATION NO. : 11/659323
DATED : April 26, 2011
INVENTOR(S) : Ozu Masao It is certified that error appears in the above-identified patent and that said Letters Patent is hereby corrected as shown below:

Title Page, insert

--(30) Foreign Application Priority Data

Aug. 6, 2004 (KR) 10-2004-0062094--

Signed and Sealed this
Ninth Day of August, 2011

David J. Kappos

David J. Kappos
*Director of the United States Patent and Trademark Office*